US007604546B2

(12) United States Patent
Brown

(10) Patent No.: US 7,604,546 B2
(45) Date of Patent: Oct. 20, 2009

(54) GOLF SWING AND PUTTING STROKE TRAINING DEVICE AND METHOD

(76) Inventor: Horace Brown, 5276 Churchward St., San Diego, CA (US) 92114

( * ) Notice: Subject to any disclaimer, the term of this patent is extended or adjusted under 35 U.S.C. 154(b) by 0 days.

(21) Appl. No.: 11/759,810

(22) Filed: Jun. 7, 2007

(65) Prior Publication Data

US 2008/0305880 A1 Dec. 11, 2008

(51) Int. Cl.
*A63B 69/36* (2006.01)
*A63B 53/04* (2006.01)

(52) U.S. Cl. ..... 473/230; 473/251; 473/330; 473/409

(58) Field of Classification Search ..... 473/219, 473/226, 230, 236, 238, 242, 249, 251, 340, 473/341, 328, 330, 280, 409; D21/735, 736, D21/759

See application file for complete search history.

(56) References Cited

U.S. PATENT DOCUMENTS

| | | | | | |
|---|---|---|---|---|---|
| 3,044,781 | A * | 7/1962 | Murphy | 473/230 |
| D193,399 | S * | 8/1962 | McGranaghan | D21/741 |
| 3,319,964 | A | 5/1967 | Steinberg | |
| 3,680,868 | A * | 8/1972 | Jacob | 473/328 |
| 3,806,129 | A * | 4/1974 | Burrows | 473/249 |
| 4,688,799 | A | 8/1987 | Johnson | |
| 4,756,535 | A * | 7/1988 | Bradley | 473/230 |
| 4,809,977 | A * | 3/1989 | Doran et al. | 473/249 |
| 5,172,915 | A * | 12/1992 | Flis | 473/230 |
| 5,207,721 | A * | 5/1993 | Lobdell | 473/230 |
| 5,362,056 | A * | 11/1994 | Minotti | 473/251 |
| 5,577,965 | A * | 11/1996 | Burgess | 473/230 |
| 5,643,098 | A * | 7/1997 | Monahan et al. | 473/230 |
| 6,547,672 | B1 * | 4/2003 | Chough | 473/230 |
| 6,863,617 | B2 | 3/2005 | Park | |
| 7,481,714 | B2 * | 1/2009 | Blanchard | 473/230 |
| 2005/0059505 | A1 * | 3/2005 | Montalembert | 473/230 |
| 2005/0259654 | A1 * | 11/2005 | Faulk | 370/392 |

* cited by examiner

*Primary Examiner*—Sebastiano Passaniti
(74) *Attorney, Agent, or Firm*—The Maxham Firm

(57) ABSTRACT

A golf training device that is equally useful in developing a putting stroke and a swing stroke. A club head is severed in the middle and a ball is rotatably secured between the head segments. A circumferential line is applied at the ball's equator defining a plane perpendicular to a line about which the ball rotates. Rotation of the ball is employed for training certain strokes or segments of strokes, and the circumferential line is employed for training certain strokes or segments of strokes.

21 Claims, 6 Drawing Sheets

GOLF SWING AND PUTTING STROKE TRAINING DEVICE AND METHOD

BACKGROUND OF THE INVENTION

1. Field of the Invention

The invention relates generally to golf training devices and methods, and more particularly to a golf training device to provide visual and tactile feedback to the user for golf strokes, both putting strokes and swing strokes.

2. Discussion of the Related Art

There are many methods and devices for improving the golf swing or putting stroke. Some work for putting strokes, some work for swings, with varying degrees of success.

Few, if any, employ a single concept for both swings and putting strokes. Generally, the putting stroke has little resemblance to swing of a non-putter, for example, a five iron. Thus, teaching methods and devices normally separate these two aspects of instruction for golfers.

As used herein, the term "golfer" will be used to refer to anyone having any type of golf club in their hands with the intention of making a golf stroke.

SUMMARY OF THE INVENTION

The invention employs a single, consistent structural concept to train both swing strokes and putting strokes. The respective methods of employing the structure differ in detail but are related.

In its simplest form, a device according to an embodiment of the invention can be an actual putter where the putter head is split in the middle to create an inner segment and an outer segment. A ball, preferably a golf ball, is rotatably mounted on a shaft connecting the two head segments and has a circumferential line around its equator. In use, a golfer employs the thus formed putting training device by developing a stroke where the putter stays on or close to the ground through a significant portion of the putting stroke, both back and through the hitting area.

In an alternative embodiment, an iron, for example, a five iron, is split in a similar fashion with a rotatable ball in the middle between the inner and outer segments. The ball has a line around its equator in the same manner as the putter embodiment. In this case the line enables the golfer to determine proper club head positions, and proper wrist pronation at several different positions of the swing.

BRIEF DESCRIPTION OF THE DRAWING

The advantages, features, and functions of the invention will be readily understood from the following description, when read in conjunction with the accompanying drawing, wherein.

DESCRIPTION OF THE PREFERRED EMBODIMENTS

Figure 1:
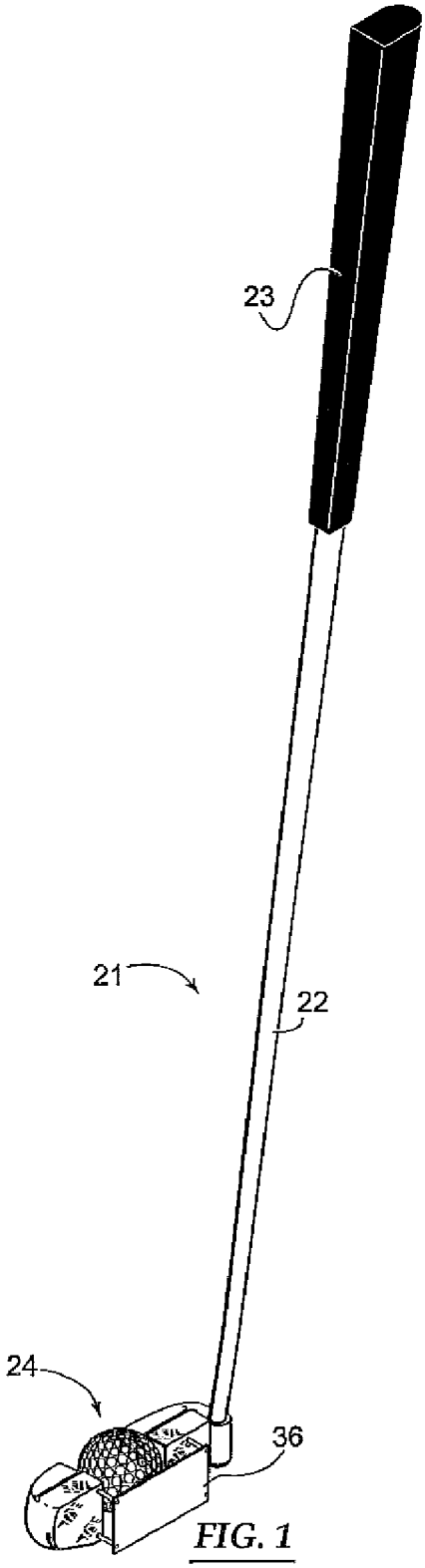
FIG. 1 is a perspective view of a putter in accordance with the invention.

Various embodiments of the invention and methods of use are described below in conjunction with the drawing figures. The particular golf clubs, and their shapes and sizes are presented for graphical purposes only and are not intended to be limited to a particular style or a particular numbered iron. A five iron was chosen only for exemplary purposes.

Putter 21 is shown in FIG. 1 having shaft 22 with grip 23, and head 24. The shaft and grip can be any style and their particularities are not relevant to this discussion of the invention.

Head 24 is shown in detail, and in two embodiments, in FIGS. 1-6. The embodiment of FIGS. 1 and 4-6 is employed where the golfer desires to actually make contact with a ball on a green while making use of the training aspects of the putting embodiment of the invention.

Figure 6:
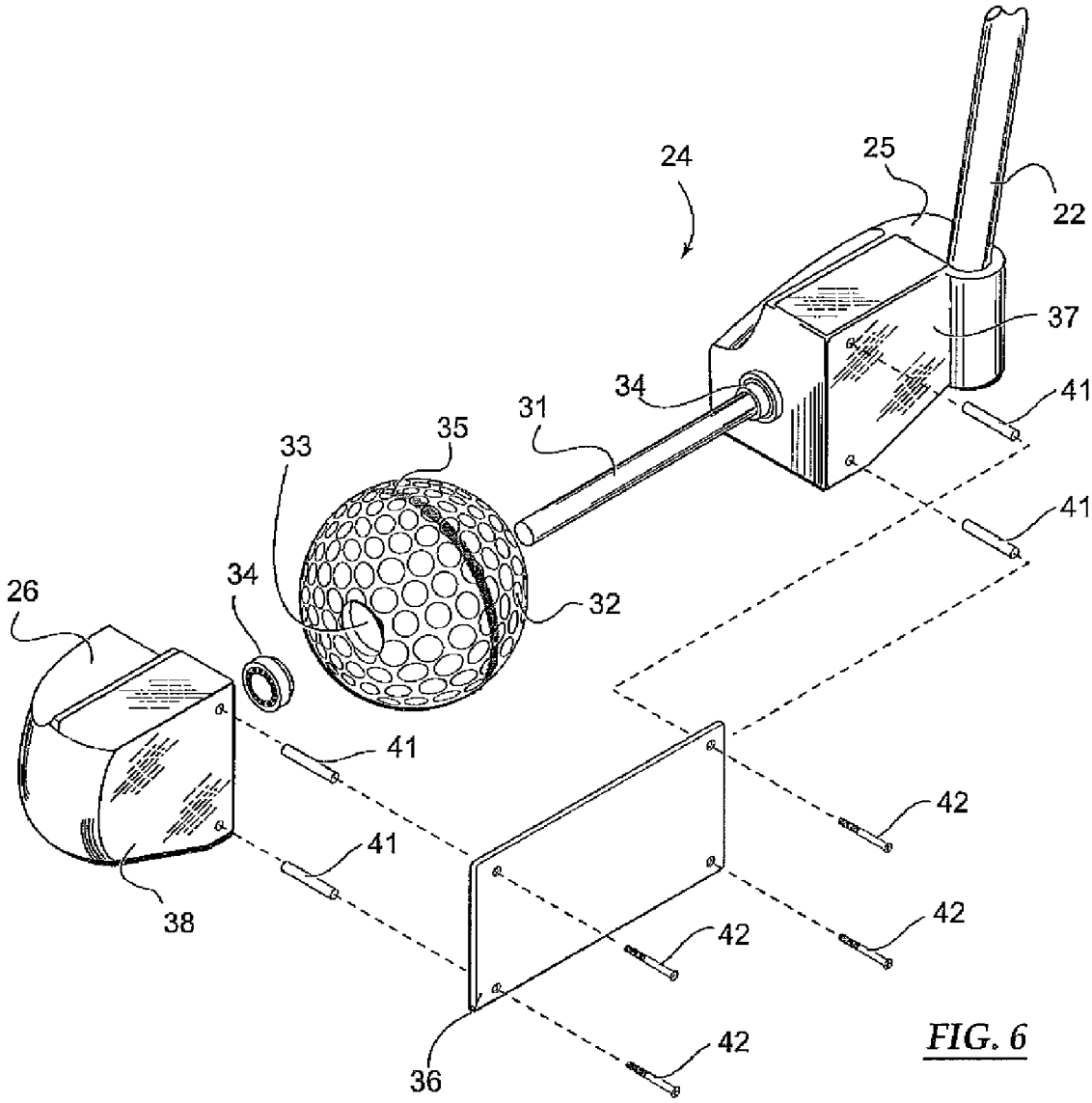
FIG. 6 is a perspective exploded view of the putter head of FIG. 1.

Inner segment 25 of head 24 is connected in a conventional manner to shaft 22. Outer segment 26 is connected to inner segment 25 by rod or shaft 31 so as to prevent relative movement between the segments. Ball 32, normally a standard golf ball but the invention is not so limited, has bore 33 there through. The bore is countersunk at each end to accommodate bearing 34, only one of which is shown in FIG. 6. A line 35 is applied at the equator of ball 32 so as to define a plane through the ball which is perpendicular to the axis of rod 31.

It is intended that ball 32 be freely rotatable on rod 31, with substantially no radial or longitudinal motion of the ball. Within tolerances, it is not possible to have absolutely no longitudinal motion of ball 32 on rod 31 without the possibility of interference and binding in contact with the head segments.

As alternatives to bearings 34, which may be roller or ball bearings, the shaft may be coated with a self-lubricating substance such as polytetrafluoroethylene (PTFE), or a sleeve of PTFE may be inserted into bore 33 to provide a bearing surface with respect to rod 31. There are likely other conventional means for enabling ball 32 to be freely rotatable on rod 31.

Figure 4:
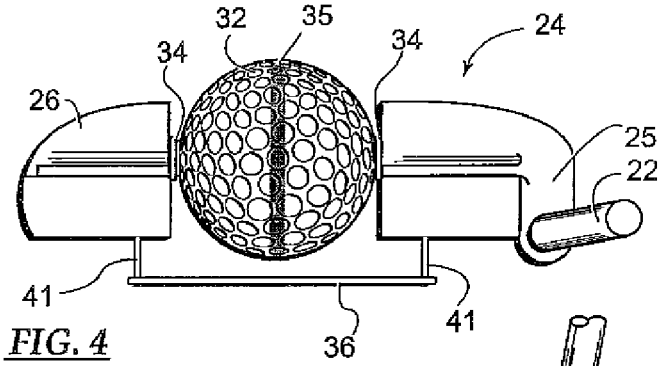
FIG. 4 is a top view of the putter head of FIG. 1.
Figure 5:
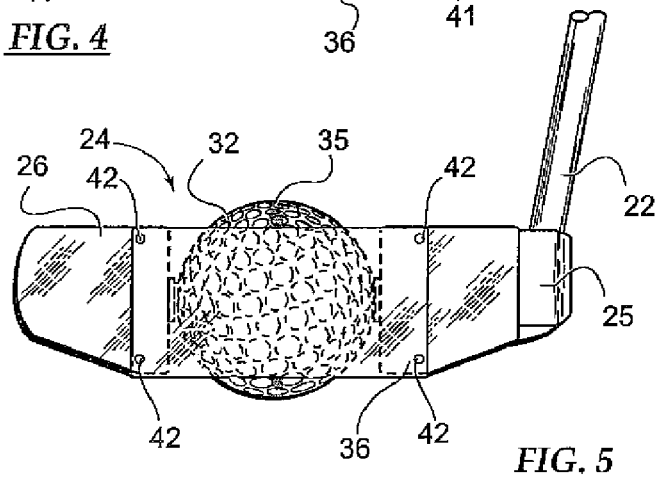
FIG. 5 is a front view of the putter head of FIG. 4.

As shown in FIGS. 1, 4, and 5, contact plate 36 is mounted to front faces 37 and 38 of respective inner and outer segments by conventional means. Standoffs 41 are provided to ensure clearance between plate 36 and ball 32. Bolts 42 may be employed to contact plate 36 and standoffs 41 to faces 37 and 38.

Figure 2:
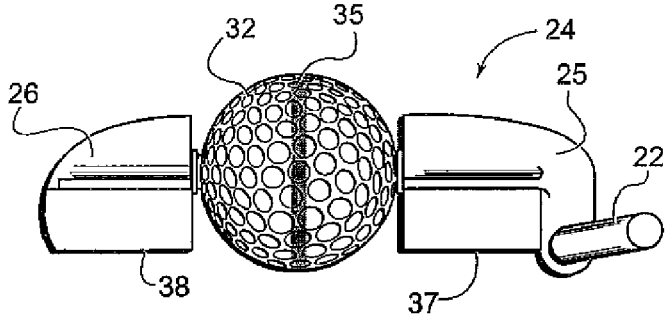
FIG. 2 is a top view of the putter head of FIG. 1 without the contact plate parallel to the front face.
Figure 3:
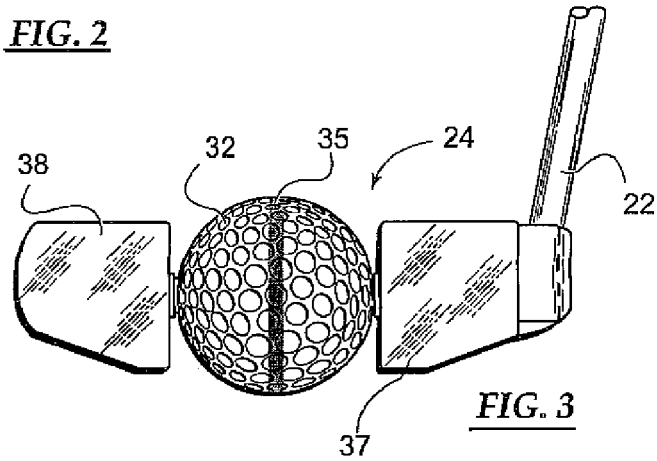
FIG. 3 is a front view of the putter head of FIG. 2.

In FIGS. 2 and 3, head 24 is not equipped with plate 36, so this embodiment is a pure training device and is not intended to contact a separate ball on a green. The method of using the putter embodiments will be described below.

It should be noted that ball 32 is in the center of the putter head, generally at the position of the center of percussion. The head is split so that the club is balanced about ball 32, that is, there is not a feeling of torque in the golfer's hands when using this training device.

Figure 7:
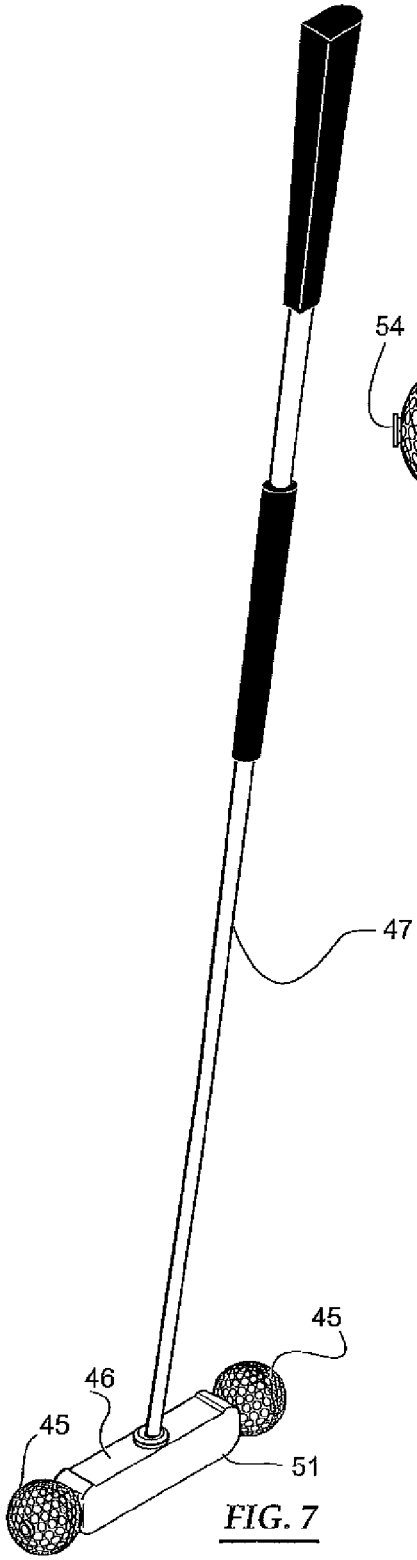
FIG. 7 is a perspective view of an alternative embodiment of a putter according to the invention.
Figure 8:
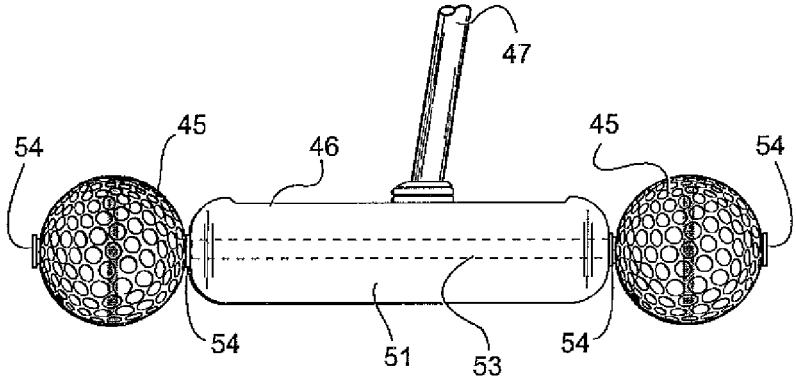
FIG. 8 is a front view of the putter head of FIG. 7.
Figure 9:
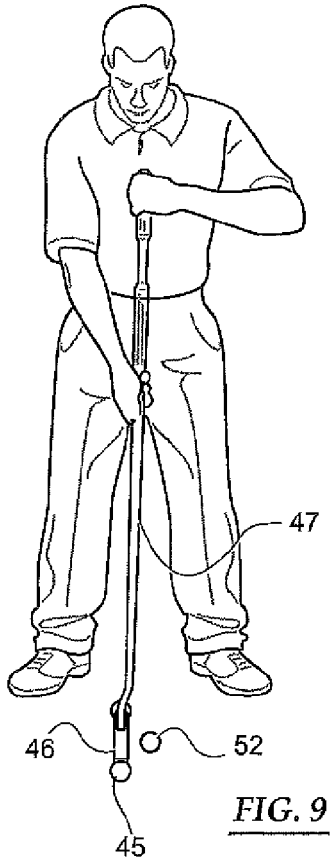
FIG. 9 shows the putter of FIG. 7 in address position.

An alternative embodiment is shown in FIGS. 7-9. This is a long-shafted putter, often termed a "belly" putter or a "chest" putter. With this structure, a rotating ball 45 is positioned on each end of putter head 46. This is a center shafted putter where shaft 46 is mounted in known fashion to approximately the center of head 46. The principle operation is the same for this embodiment as for the FIG. 1 embodiment. However, face 51 of head 46 is intended to contact a ball 52 with both balls 45 in rolling contact with the ground through the contact area. Balls 45 are mounted for free rotation on the ends of rod or shaft 53. Alternatively, stub shafts (not shown) may be mounted to either end of head 46. Bearings 54 or other friction reducing means, as previously described, may be employed to allow free rotation of balls 45.

Figures 10A, 10B, 10C, 10D:
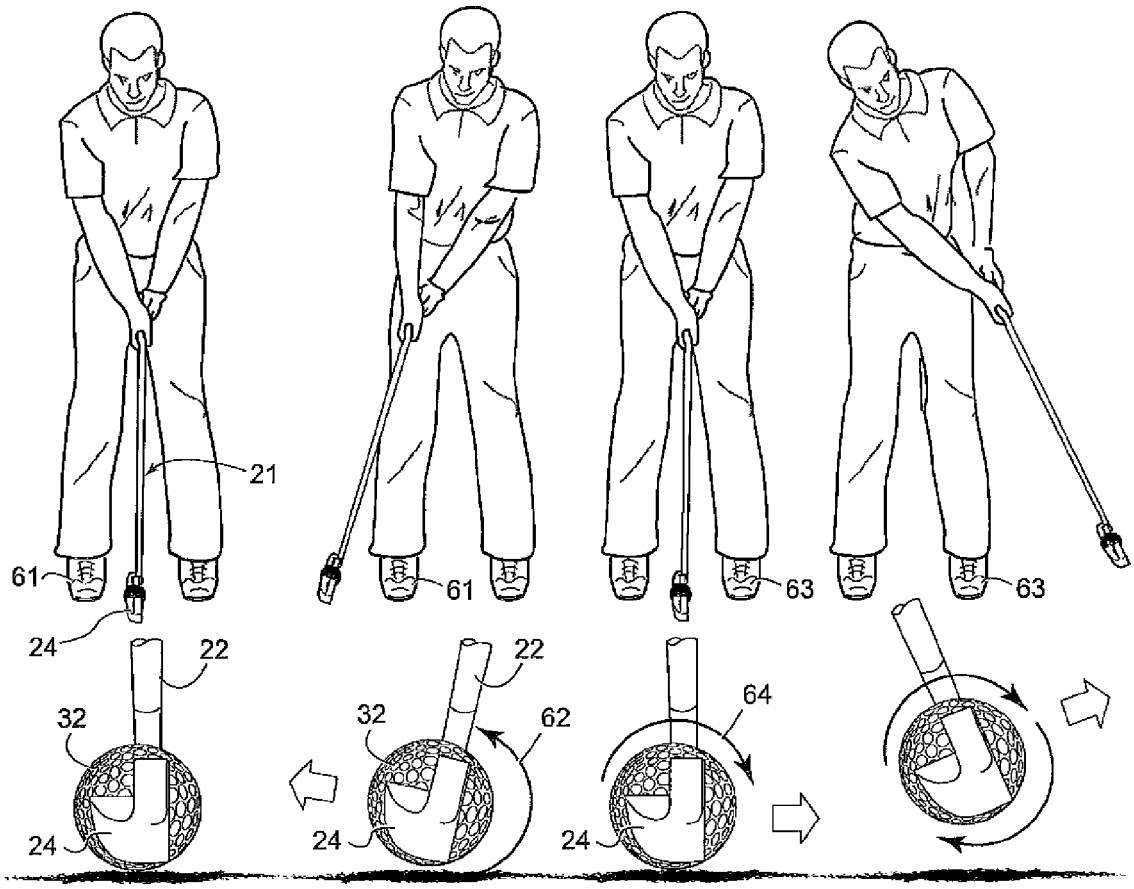
FIGS. 10A, 10B, 10C, and 10D show different positions by a golfer during a putting stroke, using the embodiment of FIG. 2.
Figure 11:
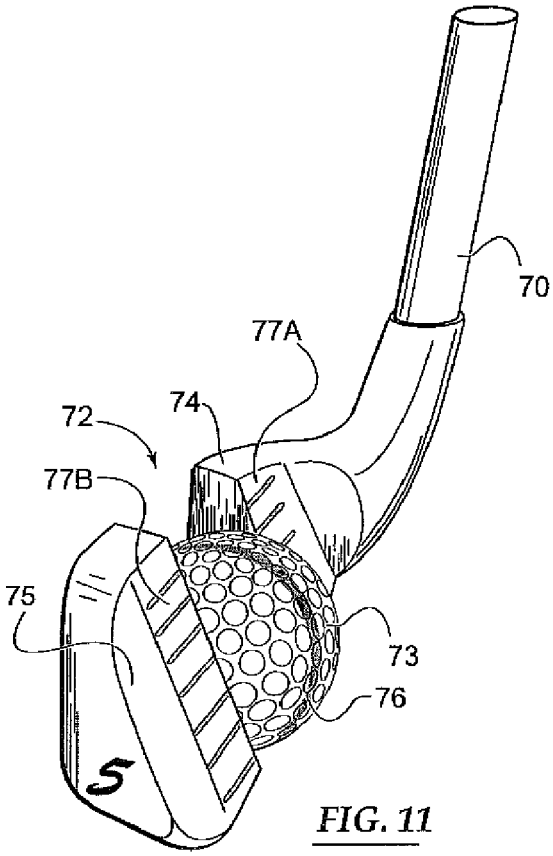
FIG. 11 is a perspective view of a five iron in accordance with the invention.
Figure 12:
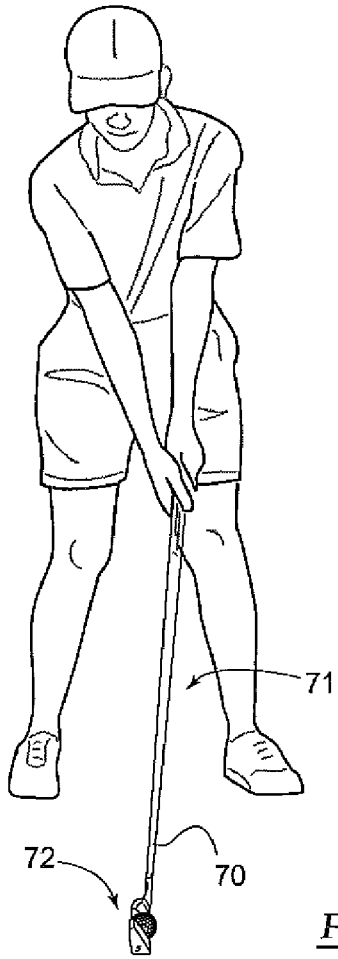
FIG. 12 shows a golfer with the embodiment of FIG. 11 at address.
Figure 13:
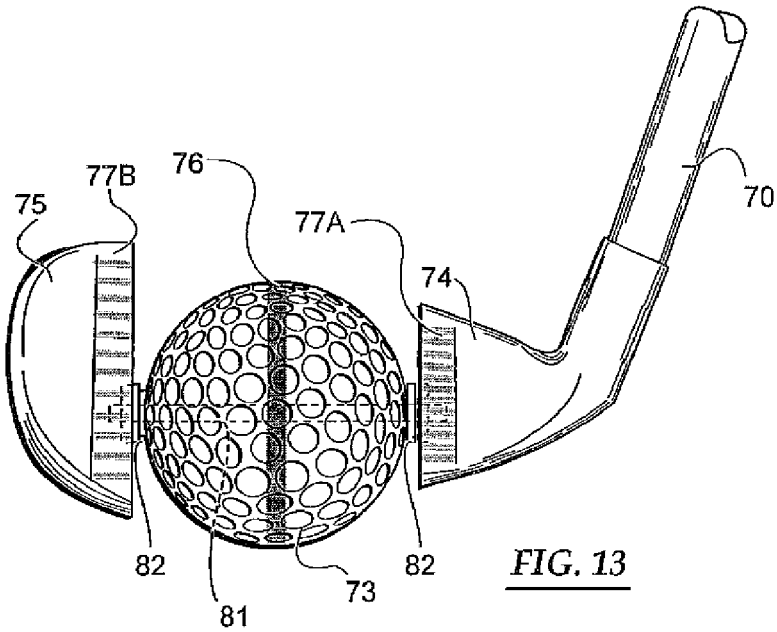
FIG. 13 is a front view of the iron head of FIG. 11.

A method of use of the FIGS. 1-6 embodiment is shown in FIG. 10. For initial training, the embodiment of FIGS. 2 and 3 is employed in FIG. 10. FIG. 10A shows putter 21 at address position. Putting stances vary widely and a common, square-alignment stance is shown for purposes of explanation and is not, itself to be considered part of the invention. For training purposes, as shown in FIG. 10B, the putter head is taken back low to the ground, staying at the ground level until head 24 is approximately even with rear foot 61. During this portion of the putting stroke, ball 32 is not lifted off the ground and the ball rotates freely along the ground as indicated by arrow 62. It is only after head 24 reaches a position opposite the rear foot that may come up off the ground, to the position shown in FIG. 10B.

On the forward portion of the stroke (FIG. 10C), ball 32 returns to a position in contact with the ground and holds in that position until head 24 is approximately even with forward foot 63. During this "contact" portion of the stroke, ball 32 is in contact with the ground and rotates in the direction indicated by arrow 64. If the putting stroke is correct, face 27 of head 24 stays perpendicular to the intended line of the putt at all times. Most importantly, the putter face remains square to the line at least during the time ball 32 is in contact with the ground.

For short putts, generally in the range of about ten feet or shorter, ball 32 never comes off the ground during a proper putting stroke. Ball 32, with circumferential line 35 being clearly visible and aligned in the direction of the intended putt, rolls smoothly in the backstroke and through the forward stroke. By training the putting stroke in this manner with the device of this invention, a proper putting stroke will be established. For longer putts, ball 32 will be raised off the ground during the backswing (FIG. 10B) and will be raised off the ground during the follow through (FIG. 10D). Again, with a proper stroke, keeping the face 27 perpendicular to the intended line, ball 32 will rotate freely after head 24 passes the contact area at the position shown in FIG. 10C, through to the position shown in FIG. 10D.

After training with the FIGS. 2 and 3 embodiment, or as an alternative to the FIGS. 2 and 3 embodiment, the embodiment of FIGS. 1, 4, and 5 may be employed. By having contact plate 36, putter 21 may be used for training by contacting an actual golf ball. The stroke principles outlined above with respect to the FIGS. 2 and 3 embodiment enables the person being trained to hit actual putts and get a feel for keeping the putter head low while observing the results of contacting a freely movable ball on a green.

Ball 32 is mounted in about the center of head 24 in order to be at the location of what would have been the center of percussion, or "sweet spot," in order to create the proper "feel" when in use. The ball is mounted so as to project below the bottom edge of face 27 by approximately 0.125 to 0.25 inch so that the bottom front edge of the face does not engage the ground during the backswing. The distance ball 32 extends below the bottom of head 24 may be somewhat less than 0.125 inch, and can be greater than 0.25 inch. In order for plate 36 to clear the ground, somewhat greater than 0.25 inch may be necessary for the ball to project below the bottom of head 24.

The principles of used described above apply equally to the embodiment of FIGS. 7-9. This long-shafted putter is intended to be employed in a manner that head 46 is aligned parallel to the ground at address (FIG. 9) and stays parallel to the ground throughout the putting stroke. Balls 45 are individually rotatable and should rotate equally during the putting stroke. If the head strays off the perpendicular orientation to the intended line of the putt, balls 45 will rotate differently, or will not rotate freely if the putter head is twisted during the putting stroke in a manner that turns face 51 so it is off line and not perpendicular to the intended line.

The principle of the embodiments of FIGS. 1-10 carries over to the FIGS. 11-14 embodiment. An iron, such as five iron 71, is shown with head 72 split into two segments with ball 73 rotatably secured between inner segment 74, mounted in known fashion to shaft 70, and outer segment 75. Circumferential line 76 encircles the equator of the ball in a plane perpendicular to face 77A and 77B. Ball 73 is rotatably mounted on shaft 81, with bearings 82 on either end of the bore through the ball, as previously described with respect to the embodiments of FIGS. 1-10.

Since the ball is rotatably mounted in head 72 in much the same manner as in the putter embodiment, further detailed discussion of that structure is not necessary with respect to the FIGS. 11-14 embodiment.

Figures 14A, 14B, 14C, 14D, 14E, 14F:
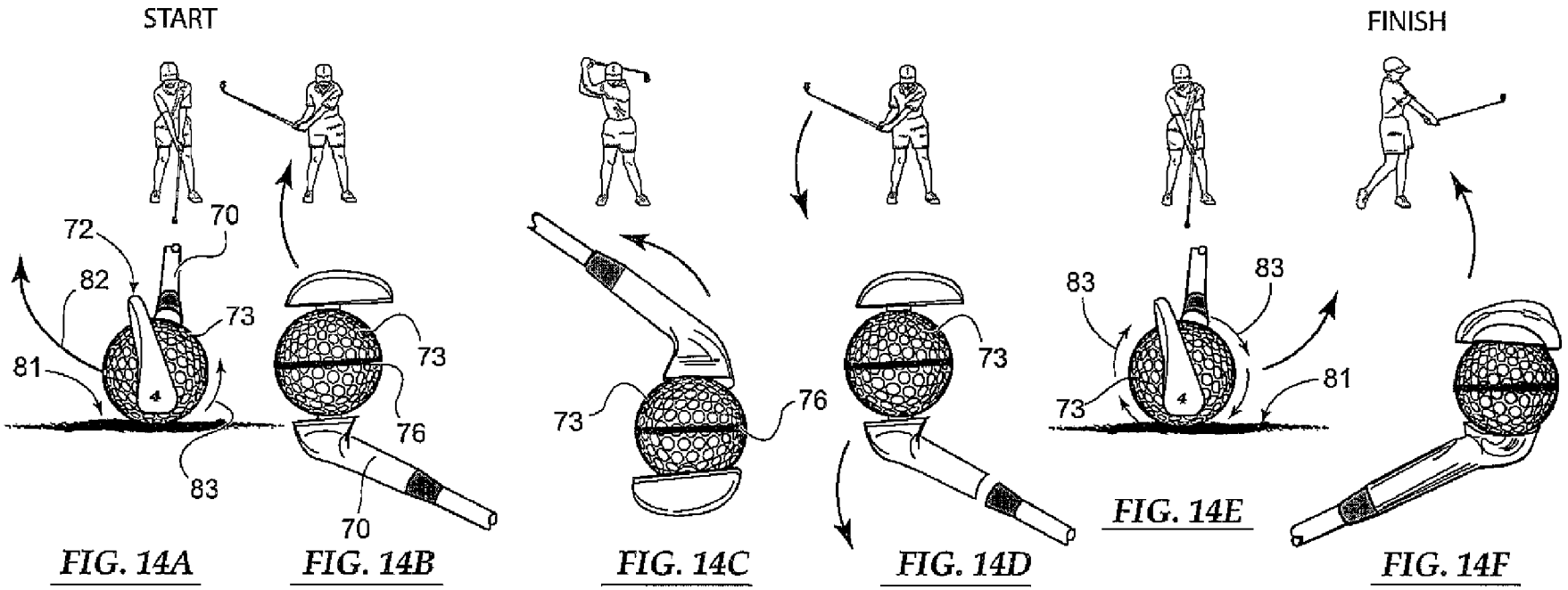
FIGS. 14A, 14B, 14C, 14D, 14E, and 14F show different positions of the golfer and the iron club head of FIG. 11 during a swing stroke.

The manner of use of the FIGS. 11-14 embodiment will now be described with respect to FIGS. 14A-14F. At address (FIG. 14A) ball 73 is in contact with ground 81. The backswing starts with ball 73 moving initially along the ground and then upwardly, as indicated by arrow 82. The ball rotates as indicated by arrow 83. When shaft 70 of club 71 reaches the position shown in FIG. 14B, with the golfer's hands at about hip-height, the golfer's wrists should be pronated so that line 76 on ball 73 is horizontal or parallel with the ground. Because the obtuse angle between shaft 70 and a line through the face of head 72 is typically about 110-120° for a five iron, shaft 70 is at about 20-30° above horizontal in FIG. 14B with the wrists properly pronated and the hands at about hip height. For a full swing the shaft may reach the position shown in FIG. 14C, that is, about 20-30° past horizontal, with line 76 on ball 73 being approximately horizontal, parallel to the ground. This position would typically be reached only when swinging a driver, and not all golfers have that long a backswing. However, for teaching purposes, the device of this invention is instructive even to this extreme. On the downswing, the wrists stay cocked, or pronated, so that face 77 of head 72 faces directly away from the golfer when the hands are at approximately hip height and the shaft angle is about 20-30° above horizontal and line 76 on ball 73 is again substantially horizontal (FIG. 14D). At the bottom of the swing, the contact area, the club and ball 73 contact ground 81 and the ball rotates forwardly, as indicated by arrows 83 (FIG. 14E). At this point the clubface is perpendicular to the intended line of flight of a ball if it were being hit, and line 76 is perpendicular to the ground, as it was at the address position. Finally, on the follow though, the wrists continue to pronate so that, at the halfway, or hip height, position (FIG. 14F), the club face is reversed (generally vertical) and faces behind the golfer and approximately parallel to the intended line of flight. Line 76 on ball 73 is once again substantially parallel to the ground at this mid-follow through position.

A golfer can practice the swing before a mirror and can immediately see if the positions of line 76 are correct at the various positions of the full swing of the club. This embodiment of the invention also enables a golf instructor to quickly report deficiencies in the golfer's swing and make corrections that can easily be perceived. As a matter of fact, with line 76 on ball 73, anyone can assist the golfer by merely observing the positions of the line at critical positions in the swing.

While an iron is employed to function as a training device for a golf swing, a single club in the form of the putter in FIGS. 1-10 could serve for both the putting stroke and the full swing. The principles can be learned equally well because the shape of the club head makes no difference in the position to be achieved of the circumferential line on the ball which is rotatably mounted in the club head. An exemplary angle of 110-120° between the shaft and the club head was employed in the description of FIGS. 11-14 above. It will be recognized that there is no set angle and in a set of clubs, that angle will vary from the lower numbered irons through the higher numbered irons.

The above description is intended to provide an example of the principles of the invention, through several embodiments. The scope of the invention is not intended to be limited to the specific examples shown and described. The appended claims are to be construed as covering all reasonable equivalents that are fairly encompassed within their respective structures and limitations.

What is claimed is:

1. A device for training golf strokes, the device comprising:

a shaft; and a putter head having a front face, said head being coupled at a predetermined angle to said shaft, said head comprising:

an inner segment connected to said shaft and including a portion of said front face;

an outer segment having a portion of said front face, said portions of said front face on said inner and outer segments are in substantially the same plane, said outer segment being aligned with and spaced from said inner segment;

a ball rotatably mounted between said inner and outer segments, said ball having a line around the equator thereof said line defining a plane perpendicular to a line between said inner and outer segments; and a contact plate connected to and spaced from said front face portions on said inner segment and said outer segment.

2. The device of claim 1, wherein said ball is a golf ball.

3. The device of claim 1, wherein said inner segment and said outer segment are in mutual fixed relationship.

4. The device of claim 1, wherein:

said ball is formed with a diametric through bore;

said inner segment and said outer segment are connected by a rod; and said ball is rotatable on said rod.

5. The device of claim 4, and further comprising bearing means to permit said ball to rotate on said rod.

6. The device of claim 5, wherein said bearing means comprises ball bearing apparatus at each end of said bore.

7. The device of claim 5, wherein said bearing means comprises a reduced friction sleeve between said bore and said rod.

8. The device of claim 1, wherein said head has a sole surface at the bottom thereof and wherein said ball is mounted to said head in a position projecting outwardly beyond said sole surface.

9. The device of claim 8 wherein said ball projects outwardly from said sole surface 0 to 0.50 inch.

10. The device of claim 8, wherein said ball projects outwardly from said sole surface 0.125 to 0.25 inch.

11. A device for training golf strokes, the device comprising:

a shaft;

a head having a front face and being coupled at a predetermined angle to said shaft, said head having a toe end and a heel end; and a ball rotatably mounted to both said toe end and said heel end of said head, each said ball having a line around the equator thereof, said lines defining spaced parallel planes perpendicular to a line through said head from said toe end to said heel end.

12. The device of claim 11 wherein said balls are golf balls.

13. The device of claim 11, and further comprising:

a rod extending from said toe end and from said heel end; and bearing means on each said ball to permit rotation thereof on said rod.

14. The device of claim 11, wherein said head has a sole surface, wherein said balls are mounted to said head in a position projecting outwardly beyond said sole surface.

15. The device of claim 14, wherein said balls project outwardly from said sole surface 0 to 0.50 inch.

16. The device of claim 14, wherein said balls project outwardly from said sole surface 0.125 to 0.25 inch.

17. A method for training golf strokes employing a device comprising:

a shaft; and a head having a front face, said head being coupled at a predetermined angle to said shaft, said head comprising:

an inner segment connected to said shaft and including a portion of said front face;

an outer segment having a portion of said front face, said portions of said front face on said inner and outer segments are in substantially the same plane, said outer segment being aligned with and spaced from said inner segment; and a ball rotatably mounted between said inner and outer segments, said ball having a line around the equator thereof, said line defining a plane perpendicular to a line between said inner and outer segments; the method comprising:

commencing the backswing by moving said head along the ground in a manner that causes rotation of said ball due to contact with the ground by said ball, said line on said ball defining a plane perpendicular to the ground;

continuing the backswing and pronating the wrists to a position at approximately hip height whereby said front face is generally vertical and said line on said ball and said shaft are generally parallel to the ground;

shifting direction to the forward swing where said ball makes contact with the ground at the bottom of the swing and continues in contact with the ground to cause rotation of said ball to a position past the bottom of the swing; and continuing the forward swing and oppositely pronating the wrists to a position at approximately hip height whereby said front face is generally vertical and said line on said ball and said shaft are generally parallel to the ground.

18. The method of claim 17, and further comprising:

continuing the backswing to a position with said shaft and said line on said ball are generally parallel to the ground.

19. The method recited in claim 17, wherein the golf stroke is a putting stroke.

20. The method of claim 17, wherein the golf stroke is a non-putting swing stroke.

21. The method of claim 18, wherein the golf stroke is a non-putting swing stroke.

* * * * *